United States Patent [19]

Campbell et al.

[11] 4,132,141

[45] Jan. 2, 1979

[54] SOLENOID-HAMMER CONTROL SYSTEM FOR THE RE-CREATION OF EXPRESSION EFFECTS FROM A RECORDED MUSICAL PRESENTATION

[75] Inventors: Joseph M. Campbell; William S. Finley, both of Lewisburg, Tenn.

[73] Assignee: Teledyne Industries, Inc., Los Angeles, Calif.

[21] Appl. No.: 680,996

[22] Filed: Apr. 28, 1976

[51] Int. Cl.[2] ..... G10G 3/04; G10H 1/02

[52] U.S. Cl. ..... 84/115; 84/1.1; 84/1.27; 84/1.28; 84/DIG. 29

[58] Field of Search ..... 84/1.02, 1.03, 1.09, 84/1.1, 1.24, 1.27, 1.28, 115, DIG. 29

[56] References Cited

U.S. PATENT DOCUMENTS

| | | | |
|---|---|---|---|
| 3,871,247 | 3/1975 | Bonham | 84/1.03 X |
| 3,905,267 | 9/1975 | Vincent | 84/115 |
| 4,023,456 | 5/1977 | Groeschel | 84/115 |

OTHER PUBLICATIONS

Service Manual for Teledyne Piano Recorder/Player Model PP-1, Assembly Number ATL-3288, Oct. 20, 1975.

Assembly Instruction for Teledyne Piano Recorder/-Player Model PP-1, Assembly number ATL-3288, Jul. 10, 1975.

*Primary Examiner*—Stanley J. Witkowski

*Attorney, Agent, or Firm*—Jim Zegeer

[57] ABSTRACT

There is disclosed an expression system for playback of a magnetic tape record rendition of a musical presentation. The detected intensity level for the bass and treble halves of the keyboard are assigned different data bit positions in the frames of recorded data bits of a time division multiplexed record system. The binary bits are weighted and used to modulate the width of pulses supplied to selected solenoids which actuate the striker-hammer members of the instrument so that the average drive energy applied to the solenoid is proportional to the desired intensity thereby more faithfully reproducing the manual action of the original performer.

2 Claims, 6 Drawing Figures

BIT ASSIGNMENT

| | | | | | |
|---|---|---|---|---|---|
| 1. | $C\#_{16}$ | 44. | G# | 87. | $B_{32}$ |
| 2. | D | 45. | A | 88. | $C_{16}$ |
| 3. | D# | 46. | A# | 89. | |
| 4. | E | 47. | B | 90. | |
| 5. | F | 48. | C | 91. | |
| 6. | F# | 49. | C# | 92. | 0 |
| 7. | G | 50. | D | 93. | |
| 8. | G# | 51. | D# | 94. | |
| 9. | A | 52. | E | 95. | |
| 10. | A# | 53. | F | 96. | |
| 11. | B | 54.. | F# | 97. | |
| 12. | C | 55. | G | 98. | 0 |
| 13. | C# | 56. | G# | 99. | |
| 14. | D | 57. | A | 100. | |
| 15. | D# | 58. | A# | 101. | |
| 16. | E | 59. | B | 102. | |
| 17. | F | 60. | C | 103. | |
| 18. | F# | 61. | C# | 104. | 0 |
| 19. | G | 62. | D | 105. | BASS THEME |
| 20. | G# | 63. | D# | 106. | BASS INTENSITY 1 |
| 21. | A | 64. | E | 107. | BASS INTENSITY 2 |
| 22. | A# | 65. | F | 108. | BASS INTENSITY 3 |
| 23. | B | 66. | F# | 109. | BASS INTENSITY 4 |
| 24. | C | 67. | G | 110. | 0 |
| 25. | C# | 68. | G# | 111. | TREBLE THEME |
| 26. | D | 69. | A | 112. | TREBLE INTENSITY 1 |
| 27. | D# | 70. | A# | 113. | TREBLE INTENSITY 2 |
| 28. | E | 71. | B | 114. | TREBLE INTENSITY 3 |
| 29. | F | 72. | C | 115. | TREBLE INTENSITY 4 |
| 30. | F# | 73. | C# | 116. | 0 |
| 31. | G | 74. | D | 117. | SUSTAIN PEDAL |
| 32. | G# | 75. | D# | 118. | SOFT PEDAL |
| 33. | A | 76. | E | 119. | |
| 34. | A# | 77. | F | 120. | |
| 35. | B | 78. | F# | 121. | 1 |
| 36. | C (MIDDLE) | 79. | G | 122. | 1 |
| 37. | C# | 80. | G# | 123. | 1 |
| 38. | D | 81. | A | 124. | 1 |
| 39. | D# | 82. | A# | 125. | 1 SYNC |
| 40. | E | 83. | B | 126. | 1 |
| 41. | F | 84. | C | 127. | 0 |
| 42. | F# | 85. | $A_{32}$ | 128. | 1 |
| 43. | G | 86. | $A\#_{32}$ | | |

(14 UNASSIGNED BITS)

FIG. 2

SOLENOID-HAMMER CONTROL SYSTEM FOR THE RE-CREATION OF EXPRESSION EFFECTS FROM A RECORDED MUSICAL PRESENTATION

The present invention is directed to electronic player pianos, and, more particularly, to a novel expression re-creation system for such instruments.

BACKGROUND OF THE INVENTION

The prior art hammer-solenoid systems disclose that to control the volume or expression, (how hard the instrument is struck) the voltage at which the solenoids are energized is varied to control the energy transferred to the instrument to re-create musical notes with the original artist's expression. In one known case, the expense to control the drive to each note would be prohibitive for producing units. There also is the question that, if sensing the volume of piano after the key is struck and then playing back, the correct timing exists to allow the volume to control the solenoid drive.

The object of the present invention is to provide a more faithful rendition of the recorded expression effects of a musical presentation.

THE PRESENT INVENTION

In accordance with the present invention, the energy supplied to one or more selected hammer-solenoid actuators is supplied by a sequence of pulses. The intensity level (or force with which the performer strikes a key) is digitized to a binary bit form and recorded on magnetic tape as a series of binary bits, in a given time frame or frames of a time-division-multiplexed signal. The width of the sequence of pulses as supplied to the solenoids is modulated in accordance with the binary bits of the digitized signal whereby the average drive intensity supplied to the selected solenoids is a function of the width of said pulses.

BRIEF DESCRIPTION OF THE DRAWINGS

The above and other objects, advantages, and features of the invention will become more apparent in light of the following specification and accompanying drawings wherein:

FIG. 2 is a chart illustrating the bit assignments in a player system incorporating the invention;

DETAILED DESCRIPTION

Attached hereto and incorporated herein as an integral part of the disclosure of this specification, is the "Service Manual" for Teledyne Piano Recorder/Player Model PP-1 Assembly Number 3288" ATL 3263, a publication of the assignee hereof and sometimes referred to hereinafter as "Service Manual".

Attached hereto and incorporated herein as an integral part of this specification is the 37 Assembly Instruction for Teledyne Piano Recorder/Player Model PP-1 Assembly Number ATL-3288 Document Number ATL 3262"; a publication of the assignee hereof and sometimes referred to hereinafter as "Installation Manual".

The above publications describe in detail a specific and preferred embodiment of an electronic player piano incorporating the invention defined in the claims hereof as made and sold by the assignee hereof.

Figure 1:
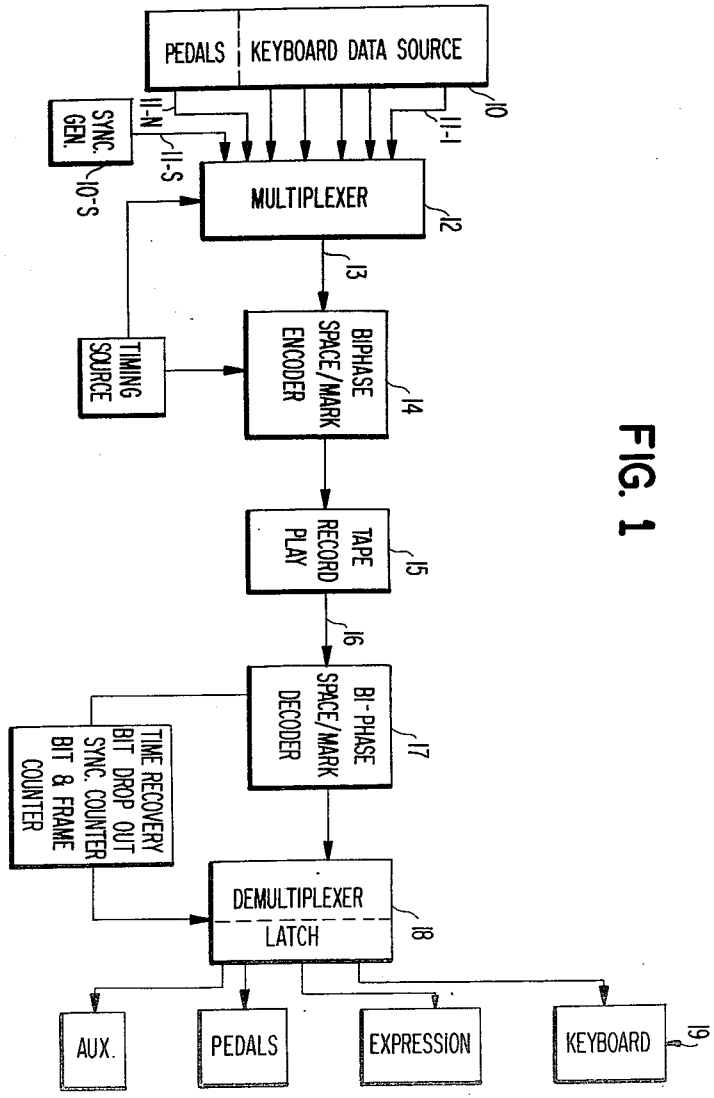
FIG. 1 is a block diagram of an electronic recorder and player system for musical instruments.

Referring now to FIG. 1, the keyboard of a piano is designated by the numeral 10 as a keyboard data source. It could be any musical keyboard instrument source such as a harpsicord, carillon, organ, piano, etc., and each output or switch actuation is indicated by a single line 11-1 through 11-N, the number of such output lines corresponding to the number of key switch actuations to be sensed and recorded for example, eighty keys, the "sustain" and "soft" pedals of an eighty-eight key piano may be sensed. A multiplexer 12 (shown in detail in said Service Manual) scans or looks at each individual line 11-1..11-N in a timed sequence which constitutes frames. Thus, the key switches, sustain and loud pedal, actuations are sensed by the digital mutliplexer 12, one at a time, and in a generally sequential fashion. However, if no transpositions are contemplated, it is not necessary that they be sequentially examined; they may be looked at or scanned in groups and in any fashion or order, the only criteria being that the position of the particular switch in its scan time be maintained in the entire system.

The multiplexer thereby translates the parallel data of the key switch actuations to a serial data stream along its output line 13. This data is then encoded to a bi-phase space (or mark) signal in bi-phase space (or mark) encoder 14 and then recorded on magnetic tape in tape recorder 15. It will be appreciated that magnetic tape recorder 15 is conventional in all material respects and need not be disclosed or described in any detail herein. It can be the same as is disclosed in any of the prior art patents referred to earlier herein for recording digital data on tape or, preferably, as shown in the included "Service" and "Installation" Manuals.

As mentioned earlier, there is a slight difference in the time when a key of a piano, for example, is struck and when the note reaches the maximum sound intensity so that if a microphone is used to detect intensity, a delay (not shown) may be introduced prior to the encoding of the keyboard binary bits at positions 1-88 of bit assignment chart of FIG. 2 (all 88 keys of a piano have assigned bit positions, but as shown in the attached "Service Manual", not all to be recorded). On the other hand, acceleration sensing devices or other forms of transducers may be used to measure the acceleration or force with which the key is struck by the artist and this data converted to binary form as the expression data for recording on tape without such delay.

The tapes may be recorded beforehand by known or accomplished artists or in home recordings, or, as presently contemplated, rerecordings of punched paper rolls, etc. which have expression signal information so that one need not equip a piano for the record function disclosed herein. Thus, the particular manner by which the expression data is detected and recorded forms no part of the present invention.

On playback by the tape recorder 15, the bi-phase space (or mark) data appears at the output of a read head and is fed through correcting networks and amplifiers to recover the digital signal. The data from the read head is approximately a sine wave, but the output from the amplifier on line 16 is a square wave signal. Moreover, the signal from the read head has included therein the clock data which is recovered and used in the demultiplexing operation.

Figure 4A:
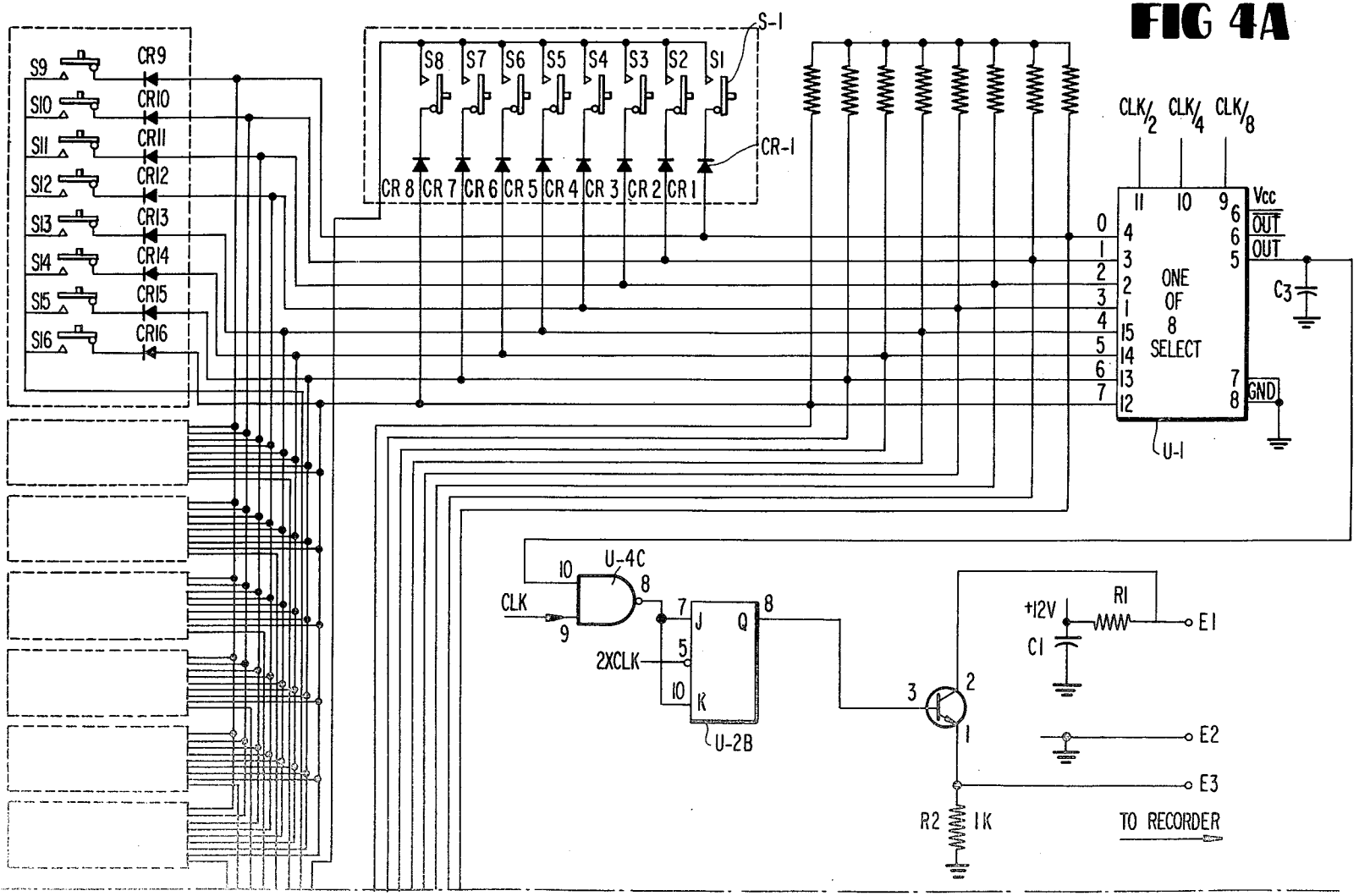
FIGS. 4A and 4B illustrate the multiplexing and coding arrangement.
Figure 4B:
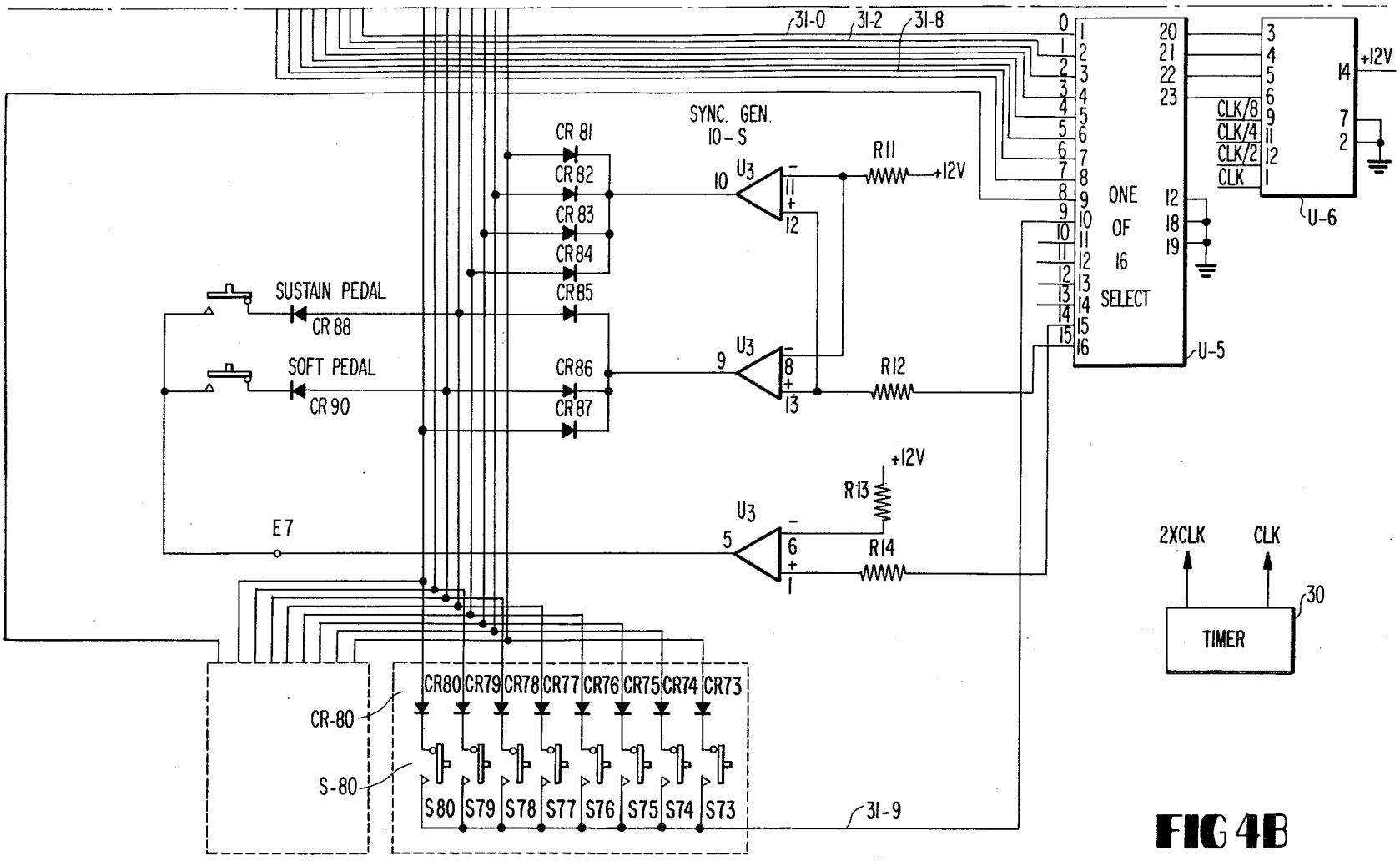

The bi-phase space (or mark) decoder circuit 17 decodes the incoming data on line 16 applies same to demutliplexer 18 which distributes the data to the appropriate control channels in the storage and solenoid actuator circuits 19. MULTIPLEXING Referring now to FIGS. 4A and 4B each of the key switches is designated by the numeral S-1, S-2. . .S-80, there being eight such switches in a module, each switch having an isolation and blocking diode associated therewith, such diodes being labeled CR-1 and associated with switch S-1 and CR-80 is associated with switch S-80, etc. These key switches are multiplexed in ten groups of eight and integrated circuit selector U-1 (each integrated circuit element is fully identified in the "Service Manual") selects them one at a time in sequential order until eight are selected. The selector circuit U-1 has as its inputs clock/2, clock/4 and clock/8 inputs from seven stage counter U-6. The input to this counter is the clock input and it comes from a clock circuit 30. Clock circuit 30 contains a conventional oscillator which with a two-stage counter on its output stage so that the output is clock and clock divided by two. The clock signals "CLK" are applied as the inputs to terminal 1, a seven stage counter U-6, which in effect is a binary decimal decoder having its coded outpus on its output terminals 3, 4, 5 and 6, respectively, applied to the input terminals 20, 21, 22 and 23 of one of sixteen select circuit U-5. Select circuit U-5 has terminals 1-17 and the first ten outputs are used as enable signals on output lines 31-0 through 31-9. Thus, each of the modules containing switches S-1 - S-80 is enabled or strobed one at a time. The clock pulses, clock/2, clock/4, and clock/8 from terminals 9, 11, and 12 of U-6 are applied to the input terminals 9, 10, and 11 of integrated circuit U-1 and in conjunction with the 12-volt supply and resistors R-3 - R-10, sequentially sample each of the switches via their blocking diodes CR-1 - CR-80. Accordingly, there appears on the output terminal of integrated circuit U-1, a series of pulses, and in the disclosed embodiment, there will be one hundred and twenty-eight bit periods within a given time frame, i.e., the time it takes for a pulse to activate output terminal 17 of one of select circuits U-5. The bit assignments are shown on Chart 1 of FIG. 2; bit positions 89-104 are not used and bit position 116 is not used along with bit positions 119 and 120. As shown on the "bit assignment chart", the sustain and soft pedals occupy bit positions 117 and 118 in the frame whereas the bit 105-109 and 111, 115 are used to activate the bass theme and bass theme intensity levels and the treble theme an treble intensity controls, respectively. Finally, bit positions 121-128 are assigned to the synchronizing bits which are generated when a strobe pulse appears on pin 17 of U-5, the zero at bit position 127 is a check bit.

THE DECODER (FIGS. 3A AND 3B)

Figure 3A:
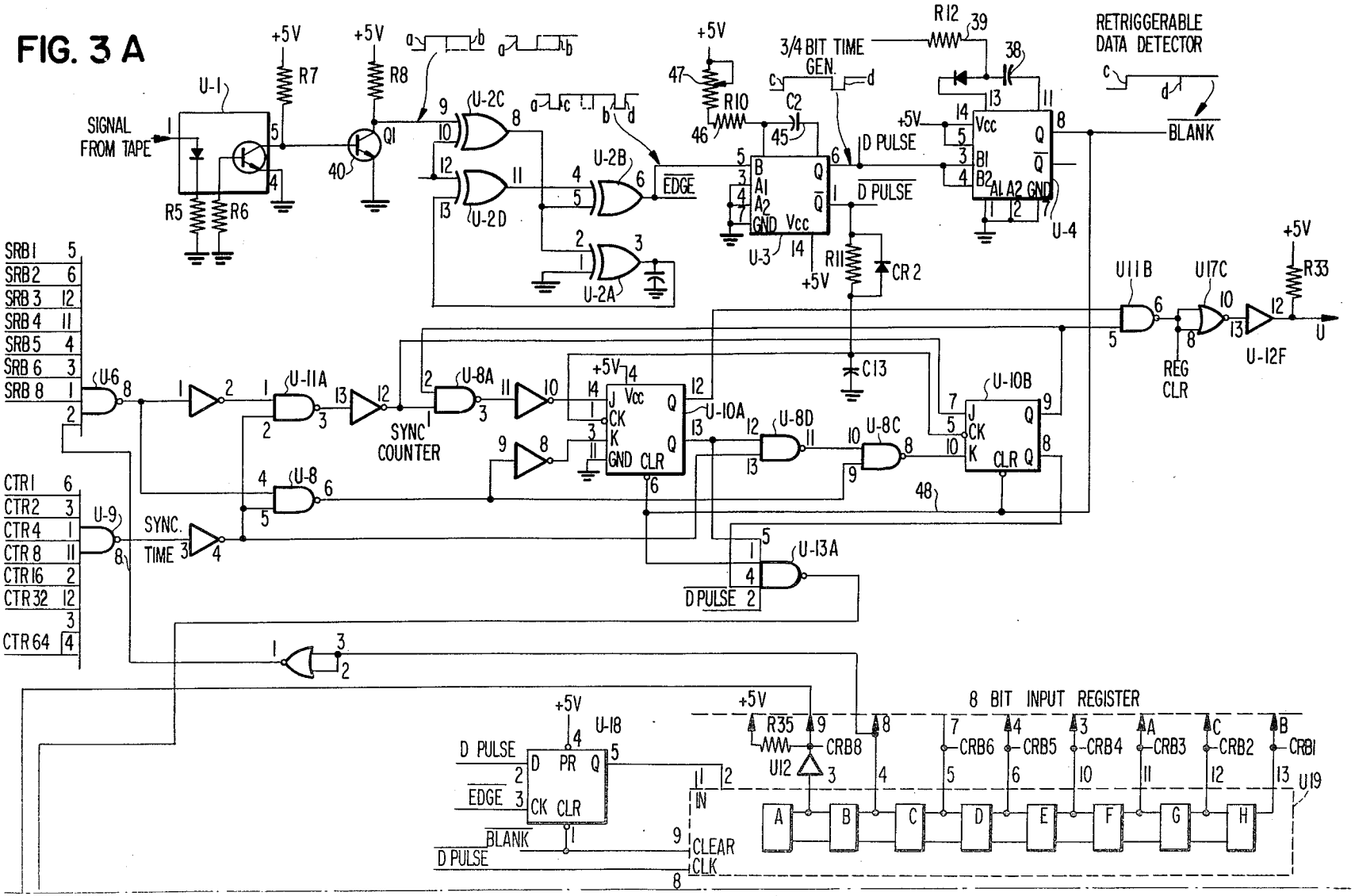
FIGS. 3A and 3B taken together are a schematic diagram of the playback circuit illustrating a preferred form of expression system incorporating the invention.
Figure 3B:
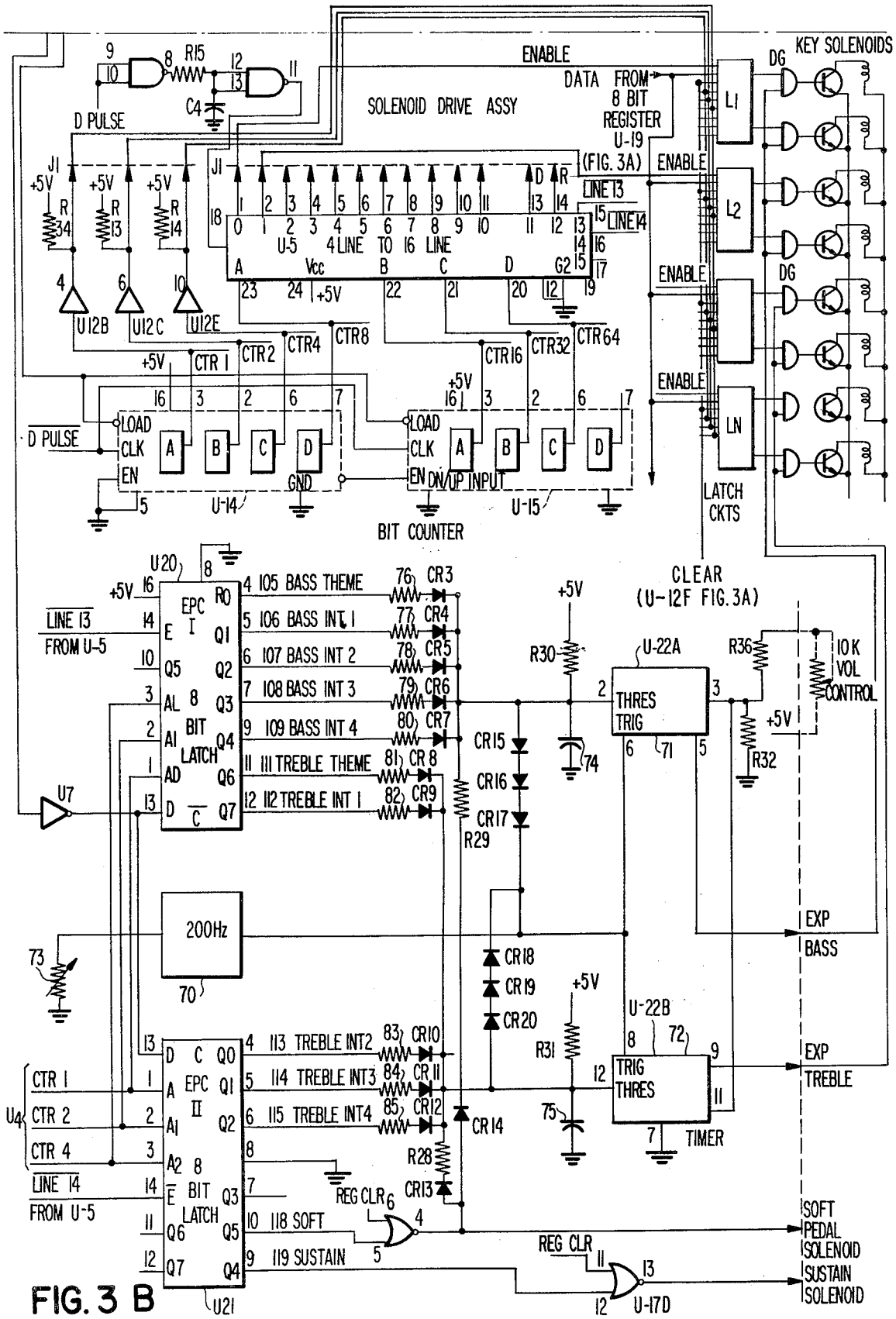

The decoder is shown in FIGS. 3A and 3B and includes the $\overline{\text{EDGE}}$ detection circuit utilizing U-2, the "D Pulse" monostable U-3, and the decoder using U-18. The four exclusive OR gates of U-2 and the delay generated by capacitor C1 generate a narrow spike called $\overline{\text{EDGE}}$ as shown in FIGS 3A. When a zero is present at pin 9 of U-2C, pin 8 will be high. This places a high at pin 2 of U-2A which will cause pin 3 to go high, delayed by capacitor C1. When pin 3 goes high, a high is placed on pin 13 of U-2D to cause pin 11 of U-2D to go low thereby placing a low on pin 4 of U-2B to cause pin 6 of U-2B to go high. At the next transition (indicated by "b" in the small waveform diagram) pin 5 of U-2B goes low and pin 4 of U-2B remains high momentarily so that a negative going pulse appears at pin 6 of U-2B. Each time a transition occurs another pulse is produced at output pin 6 and these are designated as the $\overline{\text{EDGE}}$ pulses. Each time pin 5 of the monostable multivibrator U-3 goes from zero to high its output pin 6 will go high and the multivibrator begins to time out when set by the positive pulse. As indicated on the drawings, the time out is set to be three quarter the bit time. Once monostable multivibrator U-3 has timed out, pin 6 thereof returns to zero ready to be reset. Thus, the monostable multivibrator produces one output for each bit. When pin 3 of decoder detector U-18 goes high, its output pin will reflect the status of whatever is on the input pin 2 (the D pulse). Note that in the multivibrator, pin 6 is zero during the zero to high transition of pin 6 of the $\overline{\text{EDGE}}$ detector circuits except when the bit is a one. The output terminal pin 5 of the detector remains at zero when the bits are zero and goes high when the bits are ones.

DATA DROPOUT DETECTOR

If a dropout of data occurs in the tape recording, there can be a loss of sync which causes wrong notes to be struck during the frame of data in which the dropout occurs and this can be quite disconcerting to a listener. The same disconcerting playing of notes can occur if the tape recorder is stopped while notes are being player. The circuit portion of FIG. 3A which is most significant for this aspect of the circuit is block U-4 which is the retriggerable data detector. It is a retriggerable monostable multivibrator described at pages 138-140 of Texas Instruments 1973 TTL Data Book. The output of retriggerable monostable multivibrator circuit U-4 stays high as indicated in the waveform diagram from the Q output terminal 8 for a time determined by the values of feedback capacitor 38 and resistor 39. A diode 38D is used to discharge the capacitor 38. In the beginning, pulses are applied from the tape recorder output circuit, which are amplified and applied as an input to optical couple U-1. This optical coupling circuit U-1 is conventional, having as an output thereof a square wave which is applied as an input to transistor amplifier 40.

The output of transistor amplifier 40 is the bi-phase space encoded data. The edges trigger the non-retriggerable monostable multivibrator U-3 and the length of time the Q output of this multivibrator is high is determined by capacitor 45 and resistors 46 and 47, resistor 46 being adjusted so that the D pulse output is three quarters the bit time of the information. With the bi-phase space/mark code described above, when the first zero of the data occurs, the monostable begins to trigger on the edge that exists at the end of the bit cell. As noted earlier, there is a transition at the beginning of every bit period which is the same as the end of the bit cell for the succeeding period. The edge that occurs, due to a one on the middle of the bit cell is ignored due to the timing and delay which comes about from the adjustments of the capacitors and resistors described above. The edge is then utilized to clock the CLK or clock input to D flip flop U-18, and the D pulse is applied to the D input of edge detector U-18. The negative edge of the D pulse is used to store the output of U-18 into the input register of the eight bit input register U-19. The NRZ data is recovered at the Q output of U-18 and may be supplied to a shift register (not shown) for tranposition purposes, if desired.

Referring now to the retriggerable monostable multivibrator U-4, as long as the positive going edges occur in less than the predetermined time, the monostable is reset and begins timing out again. If, due to a slow tape speed, data dropout or recorder stopping, or no information being recorded on the tape, e.g., a blank tape, no edge occurs in the D pulse input of retriggerable data detector U-4 and the device times out and clears the sync counter constituted by integrated circuits U-10A and U-10B and the input register both of which prevent notes from being struck or held in a closed state. The timing is adjusted to just longer than the expected time between the positive going edge of the D-pulse. If the edge does not occur during the expected time, the output drops and clears the system.

THE SYNC COUNTER

If there is a loss of synchronization, wrong notes can be struck by the musical instrument which can be quite disconcerting. The prior systems sensed these sync codes and automatically reset. In accordance with the present invention to insure that at power on, and at the start of a tape recorder or after a data dropout on the tape, no wrong notes are struck, a sync counter has been utilized to count three sync codes before allowing any note to be struck (these would be the three sync sequences in the bit assignment chart of FIG. 2 at bit positions 121-128). This counter is reset by the output of data detector circuit U-4 line 48 (labeled "$\overline{\text{Blank}}$") that detects if there is data dropout on the tape or the tape recorder is running at the wrong speed or that the power has just been turned on. This sync counter, constituted basically by integrated JK flip flop circuits U-10A and U-10B, also allows for the possibility that the sync code could possibly occur randomly in the data information and rejects the false sync.

The retriggerable data detector circuit U-4 has a $\overline{\text{blank}}$ output which clears the counter to a zero count if there is not any data being received, at power on, if the tape dropout occurs or if tape speed variations exist. If the Q output of U-10A or U-10B is zero, U-11B NAND gate is high, a register clear pulse clears all output registers to thereby prevent any keys (notes) from being played. Therefore, until both JK flip flops U-10A and U-10B outputs are high (one) there cannot be any notes played or struck. NAND gate U-13A output "load" holds the bit counters U-14 and U-15 to all ones count, which, in turn, is detected by NAND gate U-9. When the incoming data from U-18 is shifted through the eight bit input register U-19, and contains no sync code, the NAND gate U-6 detects same and sync detect output becomes low. When the outputs of NAND gates U-6 and U-9 are low as well as the Q output of JK flip flop U-10B and the data detector (Q of U-4) is high, the next pulse (the D pulse at Q of U-3) is coupled through resistor R-11 and diode CR-2 and delayed by capacitor 38 and clocks U-10A and U-10B as well as clocking the bit counter which has been released by U-13A load 27 output.

At this time, the J and K outputs of flip flop U-10A are zero and the J and K outputs of U-10B are one and the CLK changes U-10B Q to a one and inverted Q to a zero. The bit counter U-14, U-15 continues to count until it counts 128 counts and returns to all ones again. If the data is correct and the retriggerable data detector U-4 $\overline{\text{blank}}$ output stays high, the sync code is again in the eight bit register U-19. U-6 and U-9 detect the sync time again together which allows U-10A J to go to a one and the U-10A K to zero, while U-10B J and K go to one. When the U-10A and U-10B are clock, they both change states so as U-10A Q is one and U-10B is zero. The register clear (Reg. Clr.) signal stays high and the keys are still not allowed to play. After 128 more counts, U-10B J is high and upon clocking, U-10B Q becomes a one and the register clear becomes a zero, thus allowing the notes to be struck. In essence, then, the system requires two complete frames of 128 bits before any notes may be struck after any disturbance causing the data detector or sync detect NAND gate to indicate a malfunction. As indicated earlier, the counting of two frames of sync pulses is illustrated in the context of Vincent U.S. Pat. No. 3,905,267.

DEMULTIPLEX AND LATCH

The bit counters U-14 and U-15 along with the 8 bit input register U-19 demultiplex the serial data stream from the Q output terminal of U-18. Each succeeding group of eight bits is sequentially shifted into shift register U-19, and then transferred to latch circuits L-1, L-2. . .L-N corresponding to the number of modules (10 in this case) containing key switches S-1 - S-80. Bit counter outputs CTR-8, CTR-16, CTR-32 and CTR-64 are supplied to four line to sixteen line converter U-5 so that upon the output lines thereof appear, in sequence, enabling pulses for each of the latch circuits L. Bit counter outputs CTR-1, CTR-2, CTR-4 are the unit select inputs to expression and pedal latch circuits EPL-1 and EPL-2 (U-20 and U-21). As shown in FIG. 3B each latch circuit L1, L2. . .LN receives the data bits on their respective data input terminals D (terminal 13) from the 8-bit input register U19 (FIG. 3A) which delays the data one bit time. The data is supplied serially in the storage units of the latch circuits L1, L2. . .LN. As the data is sent, counters U14-U15 (FIG. 3B) and the 4-line to 16-line converter U5 set the storage place in the latch circuits for each bit. Thus, the counter 1, counter 2, and counter 4 outputs bits (CTR1, CTR2, and CTR4) determine which place a bit is to be stored in a group of eight so that as each latch circuit is enabled, the data bits issuing from the 8-bit input register, delayed one bit at a time, are stored in the latch circuits with the outputs of the 4-line to 16-line converter (U5 of FIG. 3B). A total of 16 groups times 8 per group which makes 128 channels with the first group being selected by the one output terminal of U5 and as indicated in FIG. 3B (see paragraph 3.5.6 "Data Transfer" of the Teledyne Service Manual).

Thus, each of the latch circuits L stores the musical information contained in a data cell of the 128 bit time frame. Driver transistor AND gates DG, one for each key on the keyboard receive as one input a signal from the latch or storage circuits L. The second input to the driver transistor AND gate DG is a sequence of pulses which are width modulated according to the information stored in expression and pedal control latch circuits EPL.

EXPRESSION

A low frequency (200 Hz) oscillator 70 supplies pulses to a pair of pulse width modulatable one shot monostable multivibrators 71 and 72 (U-22A and U-22B) for the bass and treble keys, respectively. The pulses from oscillator 70 have their minimum width set by a variable resistor 73 which thus sets the minimum width of the pulses from multivibrators 71 and 72. Each multivibrator 71 and 72 has its timing set by capacitors 74 and 75, respectively, in conjunction with resistors 76-80 for the bass volume and resistors 81-85 for the treble volume. Combinations of resistors 76-80 and combinations of resistors 81-85 are selected by the information enabled by counter bits CTR-1 - CTR-4 which have been stored in expression and pedal control latch circuits U-20 and U-21, which are enabled by two successive outputs (line 13 and line 14) from the four line to sixteen line converter U-5. This stores the treble and bass expression bits in latch circuits EPL-1 and EPL-2 along with the soft and sustain pedal controls. It will be noted that the latter are also prevented from being actuated on data drop, loss of sync, etc. by a "Register Clear" signal at U-17B and U-17D. The stored bits are used to vary the number of resistors R76-R80 and R81-R85 (which are essentially binary weighted) in circuit with timing capacitors 74 and 75, respectively, to thereby vary the charging rate of the capacitors according to the combination of resistors which have been, in effect, connected in circuit with a capacitor (74 or 75), to thereby vary the width of the pulses established by U-22A for bass effects and U-22B for treble effects.

The bass effect pulse width pulses are supplied to the group of driver transistor AND gates DG-B for the bass notes solenoid control as the second input thereto and the treble effect pulse width modulated pulses are supplied to the driver transistor AND gates DG-T for the treble note solenoid control transistors.

If the sync pulse sequence is detected and there has been no loss of sync, data dropout, etc. as described above, the musical notes stored in the latch circuits are played.

It will now be seen how the invention accomplishes its various objects and the various advantages of the invention will likewise be apparent. While the invention has been described and illustrated herein by reference to certain preferred embodiments, it is to be understood that various changes and modifications may be made in the invention by those skilled in the art, without departing from the inventive concept, the scope of which is to be determined by the appended claims.

What is claimed is:

1. A method of producing variable intensity in a solenoid actuated musical note producing instrument comprising the steps of recording a digitally coded signal representing the desired intensity level, producing a sequence of pulses for selectively energizing one or more of the solenoids in said solenoid actuated musical note producing instrument and modulating the width of the pulses in said sequence of pulses according to the intensity level in said recorded digitally coded signal whereby the average drive energy applied to said solenoid is proportional to said desired intensity level.

2. In an apparatus for the re-creation of a magnetic tape recorded musical presentation of a keyboard instrument by solenoid actuation of the re-creating instrument, and to re-create expression effects thereof, comprising:

means for recording on said magnetic tape a sequence of binary bits, the said binary bits being weighted corresponding to a given intensity level, means for reading said binary bits, means for producing a sequence of pulses of uniform amplitude and energizing said solenoid thereby, and means for modulating the width of said pulses in said sequence applied to one or more selected solenoids in accordance with the weight of said binary bits to thereby vary the average drive intensity of said selected solenoids as a function of the width of said pulses to thereby re-create said expression effects on the keyboard instrument.

* * * * *